United States Patent [19]

Baum

[11] Patent Number: 4,753,399

[45] Date of Patent: Jun. 28, 1988

[54] DRUM OF A WINCH

[75] Inventor: Leo A. Baum, Ratingen, Fed. Rep. of Germany

[73] Assignee: Putzer-Defries Winden-und Hebetechnik GmbH, Ratingen, Fed. Rep. of Germany

[21] Appl. No.: 944,250

[22] Filed: Dec. 19, 1986

[30] Foreign Application Priority Data

Aug. 26, 1986 [DE] Fed. Rep. of Germany ..... 3628925

[51] Int. Cl.[4] ..... B65H 75/18; B65H 75/14

[52] U.S. Cl. ..... 242/117; 242/118.4; 242/125.1

[58] Field of Search ..... 242/117, 77.3, 118.4, 242/118.8, 125.1

[56] References Cited

U.S. PATENT DOCUMENTS

| | | | |
|---|---|---|---|
| 2,521,922 | 9/1950 | Kurtz | 242/77.3 |
| 2,589,048 | 3/1952 | Bureau | 242/77.3 |
| 2,741,441 | 4/1956 | Le Bus | 242/117 |
| 3,063,653 | 11/1962 | Arnold | 242/117 |
| 3,135,478 | 6/1964 | Harlander | 242/117 |
| 3,452,946 | 7/1969 | Starratt | 242/118.8 |
| 4,210,295 | 7/1980 | Brusselle | 242/125.1 |

*Primary Examiner*—John M. Jillions
*Assistant Examiner*—Steven M. du Bois
*Attorney, Agent, or Firm*—John F. A. Earley; John F. A. Earley, III

[57] ABSTRACT

A winch drum is assembled from parts which are preferably joined by welding and comprises a first flanged-coupling pulley having a pivot, a tube disposed in between first flanged-coupling pulley and a second flanged-coupling pulley, and a connecting disc attached to the tube adjacent to second flanged-coupling pulley.

15 Claims, 2 Drawing Sheets

DRUM OF A WINCH

Figure 1:
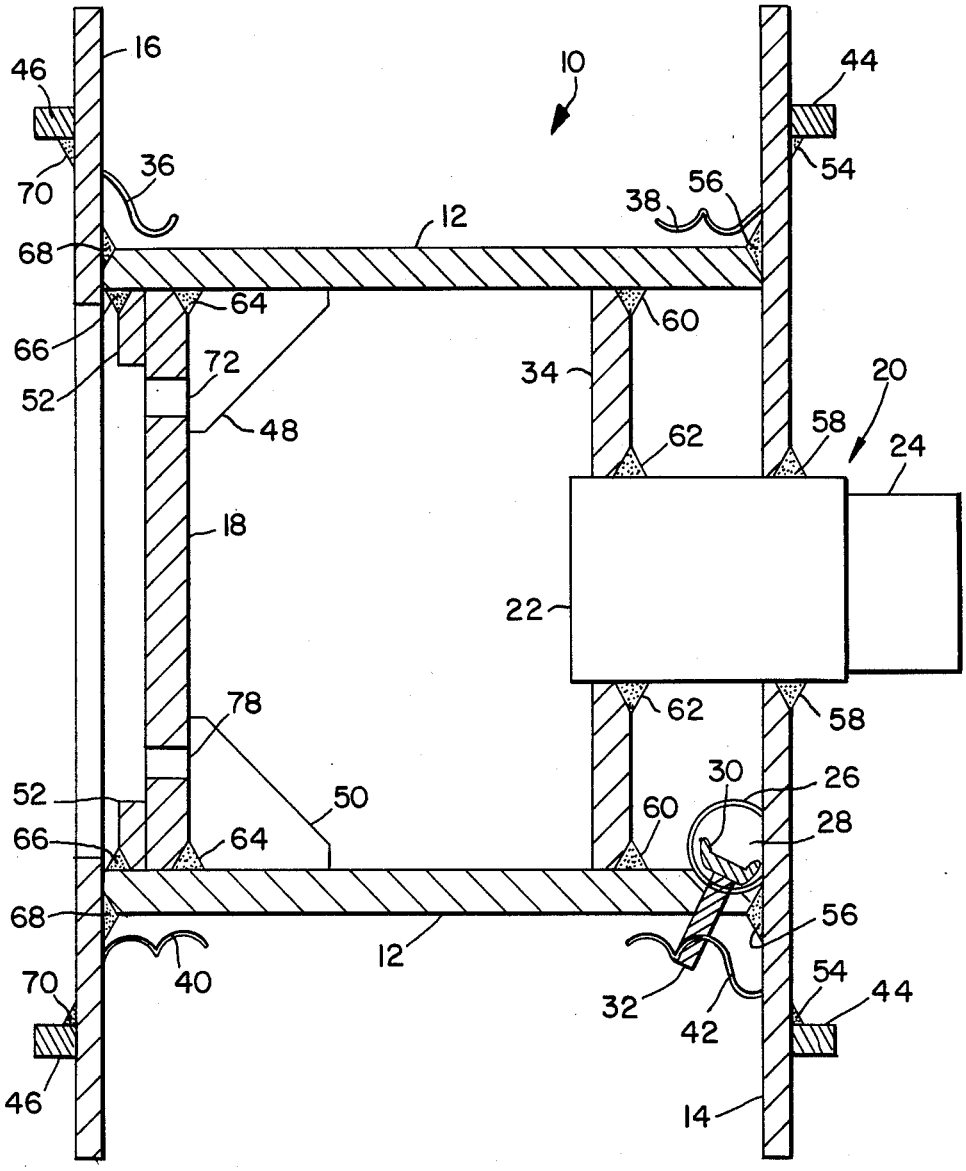

The present invention relates to a drum of a winch for coiling up or uncoiling a cable for use in hoisting or hauling means. In particular, the present invention relates to a drum of a winch for use with high loads exceeding 20 kN, preferably exceeding 45 kN.

Prior art drums of a winch are usually manufactured by casting iron. If drums for winches suitable for higher loads are desired such cast iron parts are difficult to manufacture and therefore expensive; such parts also have a considerable weight and are difficult to adapt to different applications, for example for different load ranges.

It is therefore an object of the present invention to improve prior art drums of a winch and to provide a drum of a winch which is less expensive to manufacture and which can easier by adapted to different load ranges. It is a further object of the present invention to provide an even load distribution even at high loads.

These objects are achieved by providing a drum of a winch which is assembled from parts which are preferably joined by means of weldings, said drum comprising a first flanged-coupling pulley with a pivot disposed therein and having a tubular section disposed in between said first flanged-coupling pulley and a second flanged-coupling pulley, said drum further comprising a connecting disc arranged in adjacent relationship to said second flanged-coupling pulley and secured to said tubular section.

The drum of a winch according to the present invention has numerous advantages. The structure of the drum according to the present invention which is assembled from parts joined to each other by weldings eliminates the need for casting, which would have to be preceeded by manufacturing particular casting molds. These parts of the drum of a winch according to the present invention can be made from steel sheets or steel tube sections, respectively, using common metal working techniques. It is no longer necessary to have molds for different embodiments in stock. Load requirements for higher loads occuring in such applications may easily be taken into account by arranging additional reinforcing elements in sections where additional stress occurs. Therefore, the drum of a winch according to the present invention can be universally employed. Parts joined to each other by welding may be replaced comparatively easy and fast, if single parts have been damaged or worn, and this leads to less idle time and facilitates handling of the drum according to the present invention. A further advantage of the drum of the winch according to the present invention is its reduced weight, compared to prior art winch drums manufactured by casting techniques, because loads for each single application may be supported by suitably adapting the dimensions of parts and/or by providing additional reinforcing elements.

According to a preferred embodiment of the invention two semimonocoque parts are arranged at the outer peripheral surface of the tube and the semimonocoque parts comprise winding grooves for guiding the cable. In this manner the function of the tube which is essentially stressed in a radial direction by the cable and the load connected thereto may be separated from the function of the winding grooves for the cable which are meant to provide an even coiling up of the cable on the cable drum. Semimonocoque guiding parts may be manufactured comparatively easy and economically and may be fixed to the tube easily, for example by slot welding. Worn semimonocoque guiding parts may easily be replaced. Furthermore, the semimonocoque guiding parts may be made of a different material as compared to the tube material, and this would certainly not be feasible with prior art drums which are integrally manufactured by casting.

According to another preferred embodiment of the invention which has further advantages the ratio of the diameters of the tube section and the cable exceeds 13, preferably 20. Surprisingly this dimensioning, which is easily feasible by adjusting the tube diameter in reaction to a predetermined load and a predetermined cable material, leads to an outstanding efficiency of the drum of a winch according to the present invention, with respect to a high form stability and a uniform distribution of forces occuring during coiling up and uncoiling of a cable, and in this manner high safety requirements may be met.

Prior art drums of winches usually have a recess for receiving the cable at the winch drum and the cable is guided into the recess and secured there by soldering and by wedges. Deeper recesses and/or larger cable diameters in particular make it difficult to determine the quality of the soldering joint between cable and winch drum. In this respect another preferred embodiment of the invention suggests to provide a cable receiving means comprising at least one clamping means for the cable. By providing such clamping means a defined and predetermined attachment of the cable may be provided by constructional measures in an easy manner.

In this respect it is advantageous if the clamping means comprises at least one pressing screw aligned in a radial direction with respect to the longitudinal axis of the cable receiving means, such pressing screw acting upon a clamping jaw. The shape of the clamping jaw can be adapted to the outer diameter of the cable to be secured, and by fastening the pressing screw with a torque of predetermined level the clamping action and, therefore, the attachment of the cable may be easily adjusted.

For a uniform distribution of the clamping load exerted on the cable according to another preferred embodiment of the invention two pressing screws, each pressing screw acting on a respective clamping jaw, may be provided.

The connecting disc serves for connecting the drum of a winch to suitable driving means, for example a flange of a drive motor. For higher loads a weight-reducing embodiment of the connecting disc may be provided by employing ribs for supporting the connecting disc with respect to the inner peripheral surface of the drum tube. The dimensions, the number and the arrangement of the ribs may easily be adapted to corresponding applications. Preferably the ribs are connected to the connecting disc and the inner peripheral surface of the tube by means of welding.

Similar advantages may be provided for the first and/or second flanged-coupling pulleys which may have ribs at their inner surfaces extending essentially in a radial direction.

A particular simple and stable embodiment with a useful load distribution may be provided by arranging, according to another preferred embodiment of the invention, six ribs in evenly spaced relationship, where the angle between adjacent ribs is 60°.

The connecting disc is used for transmitting radial and axial forces to a driving means connected thereto. For this purpose threaded screws are usually employed, the threaded part of which extends essentially in an axial direction and such threaded screws are of little use for transmitting radial forces, as the outer flanks of the threads may be impaired. A still further preferred embodiment of the invention suggests to provide, in the connecting disc, threaded holes as well as holes adapted for receiving dowel pins. As dowel pins have no threaded flanks they are much better adapted, as compared to threaded screws, to transmit radial forces. Threaded screws, on the other hand, are exceptionally useful for transmitting axial forces. The connecting disc is advantageously equipped with symmetrically arranged threaded holes and symmetrically arranged holes adapted for receiving dowel pins, respectively. A further advantage is provided by arranging the threaded holes and the holes for the dowel pins, respectively, in alternating fashion, and in this respect another preferred embodiment of the invention suggests to arrange, on a circle around the center of the connecting disc, a threaded hole adjacent to a hole for a dowel pin, followed by another threaded hole, and so on.

Figure 2:
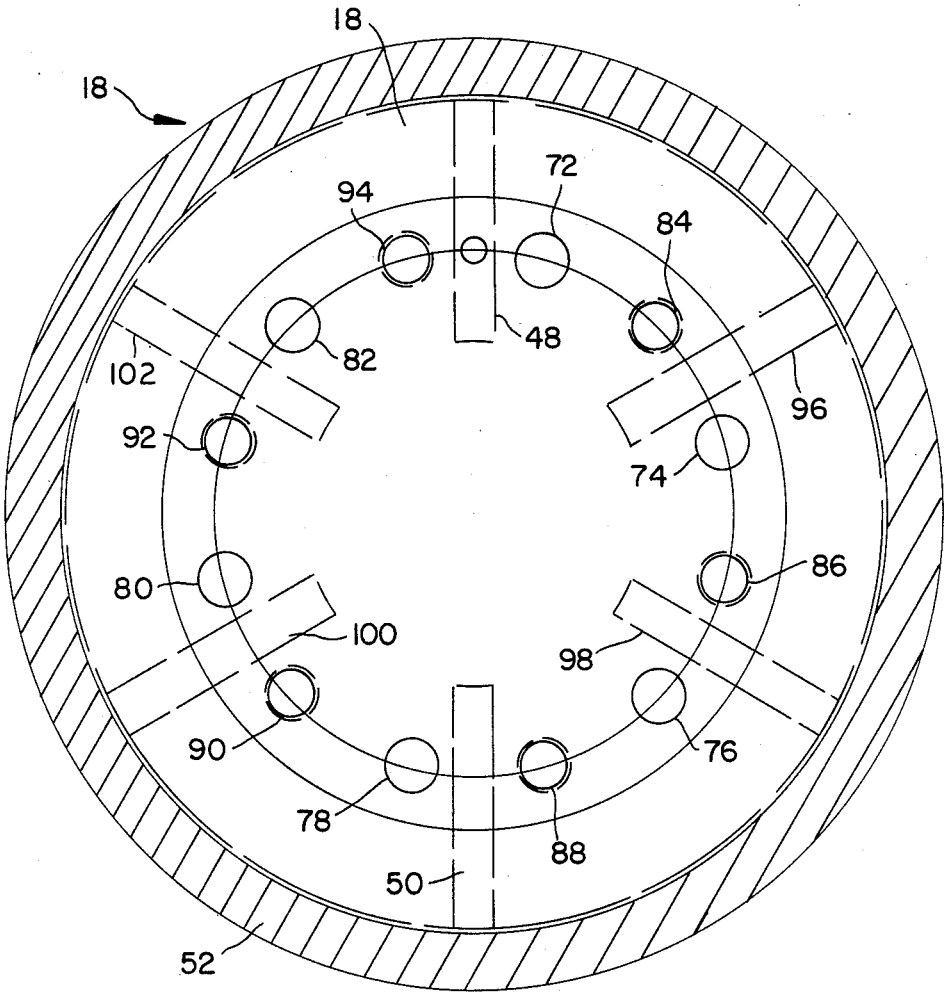

The invention will be further described in detail in connection with the drawings depicting further advantages and features. In the figures:

FIG. 1: shows a longitudinal section through a drum for a winch according to the present invention; and FIG. 2: is a side view in a direction from the outer face of a second flanged-coupling pulley to a connecting disc according to the present invention.

FIG. 1 shows a drum 10 of a winch with a central tube 12, at the ends of which a first flanged-coupling pulley 14 is attached by means of a welding 56 and a second flanged-coupling pulley 16 is attached by means of a welding 68. A first semimonocoque guiding part 36, 38 extends with an end section 36 from flanged-coupling pulley 16 to a second end section 38 which is adjacent to first flanged-coupling pulley 14. The intermediate section of the semimonocoque guiding part, between end sections 36 and 38, is not shown in FIG. 1. In section 36 of the semimonocoque guiding part one winding groove for a cable is shown, and in section 38 of first semimonocoque guiding part two winding grooves for the cable are discernable. The second semimonocoque guiding part 40, 42 extends, in a similar manner, from second flanged-coupling pulley 16 to a first flanged-coupling pulley 14; as already described in connection with first semimonocoque guiding part 36,38 only the end sections 40 and 42, respectively, are shown in the figure. Two winding grooves for the cable are shown in section 40 and two further grooves in section 42.

Inside tube 12 and adjacent to second flanged-coupling pulley 16 a connecting disc 18 is provided which extends over the inner diameter of tube 12 and has a reinforcement ring 52. Connecting disc 18 serves for connecting to a suitably designed driving means which is not shown in the figure, for example a flange of a drive motor. Connecting disc 18 is fixed to the inside of tube 12 by means of a welding 64 and ring 52 is fixed to the inside of tube 12 by means of a welding 66.

For reinforcement and guiding purposes first flanged-coupling pulley has a closed ring 44 attached by a welding 54, and second flanged-coupling pulley 16 is provided with a similar ring 46 attached to second flanged-coupling pulley 16 by means of a welding 70. Rings 44, 46 have a larger diameter than tube 12. For providing further support to connecting disc 18 equal-angle rectangular ribs 48, 50 are provided which are attached (not shown in the figure) for example by means of welding to connecting disc 18 and the inner peripheral surface of tube 12, respectively. The arrangement of ribs 48, 50 and of further ribs will be subsequently explained in more detail in conenction with FIG. 2.

In a central receiving section of first flange-coupling pulley 14 a pivot 20 with a pivot body 22 and a bearing part 24 is provided. Bearing part 24 extends from first flanged-coupling pulley 14 axially into the inside of tube 12 and is received in the center of another disc 34.

Fastening of pivot body 22 is by means of a welding 58 at first flanged-coupling pulley 14 and by means of a welding 62 on further disc 34. Disc 34 itself is securely fastened to the inner peripheral surface of tube 12 by a welding 60 and serves to reinforce drum 10 of the winch in a similar manner as explained in connection with connecting disc 18.

Pivot 20 serves for supporting winch drum 10 at the side of first flanged-coupling pulley 14, and for this purpose bearing part 24 of pivot 20 is received in a bearing which is not shown in FIG. 1. The other side of winch drum 10 is supported by connecting disc 18 and a driving means attached thereto which is not shown in the figure.

A cable receiving means with a tubular part 26 is shown in the sectional view of FIG. 1 in the lower connecting section in between tube 12 and first flanged-coupling pulley 14. Tubular cable receiving means 26 is secured, in a manner not shown in the figure, to first flanged-coupling pulley and/or tube 12. For securing a cable an end section of the cable is introduced sufficiently far into the inner chamber 28 of tubular cable receiving means 26. A clamping jaw 30 has a face section adapted to the outer dimensions of the cable facing opening 28 and serves for pressing the cable against the opposed inner wall of tubular cable receiving means 26, and for this purpose a pressing screw 32 is provided of which only the shaft section is shown in the figure. Pressing screw 32 is guided by engaging a threaded hole in tube 12. Obviously (which is not discernable in the sectional view of FIG. 1) several clamping jaws with several pressing screws can be provided next to one another along the longitudinal extension of tubular cable receiving means 26.

FIG. 2 is a view of connecting disc 18 in a direction from second flanged wheel 16 to the inside of tube 12. The flanged-coupling pulley (flanged wheel) has a central opening corresponding to the inner diameter of tube 12. In the outer section of connecting disc 18 the reinforcement ring 52 is discernable. On a circle around the center of connecting disc 18 six threaded holes 72, 74, 76, 78, 80, and 82 and six holes 84, 86, 88, 90, 92, and 94 for dowel pins (not shown) are provided. Threaded holes 72 to 82 and holes 84 to 94 serve for connecting to a suitable driving menas, and more particular dowel pins are provided which are received in holes 84 to 94 and extend through a connecting part of the driving means and through connecting disc 18 for taking up essentially radial loads, whereas axial loads are essentially received by threaded screws arranged in threaded holes 72 to 82.

In the top view on connecting disc 18, as shown in FIG. 2, the ribs 48, 50 already mentioned in connection with FIG. 1 are not directly visible as they are arranged at the back side of the disc and the ribs are, therefore, shown in dashed lines. It is further discernable from FIG. 2 that further ribs 96, 98, 100 and 102 are provided and the ribs 48, 96, 98, 50, 100 and 102 are arranged symmetrically in a star-shaped fashion and extend essentially in a radial direction with respect to connecting disc 18.

The winch drum shown in FIGS. 1 and 2 is suitable for heavy load applications, that is for loads exceeding 20 kN, even for loads exceeding 45 kN. For this purpose the diameter of drum 12 is chosen to be at least 13 times, preferably 20 times larger than the diameter of a cable required for such loads.

What is claimed is:

1. A drum of a winch for coiling and uncoiling a cable for use in hoisting or hauling comprising a tube having first and second end portions, a first flanged-coupling pulley having a central aperture being welded to the first end portion of the tube, a second flanged-coupling pulley having a central aperture being welded to the second end portion of the tube, a pivot being disposed in the central aperture of the first flanged-coupling pulley and being welded thereto, a connecting disc for connecting the drum to a suitable means for driving the drum being welded to the inside of the tube at the tube second end portion, threaded holes symmetrically arranged in the connecting disc for receiving screws which connect the drum to the driving means and which receive the axial loads on the drum, non-threaded holes symmetrically arranged in the connecting disc for receiving dowel pins which connect the drum to the drive means and which receive the radial loads on the drum, and a plurality of ribs welded to the connecting disc inside the tube for providing a support against the inner circumferential surface of the tube.

2. A drum of a winch as claimed in claim 1, further including a first semimonocoque guiding part having a plurality of grooves being provided on the outer peripheral surface of the tube, a second semimonocoque guiding part having a plurality of grooves being provided on the outer peripheral surface of the tube, the grooves of the first guiding part being substantially the same size of the grooves of the second guiding part, the grooves of the second guiding part being displaced laterally by approximately one-half the width of a groove.

3. A drum of a winch as claimed in claim 1, wherein the ratio of the diameter (D) of said tube means (12) to the diameter (d) of said cable is larger than 13, preferably larger than 20.

4. A drum of a winch as claimed in claim 1, further including a plurality of ribs located within the tube being welded to and extending between the connecting disc and the tube, said ribs extending essentially in a radial direction.

5. The drum of a winch as claimed in claim 1, further including a plurality of ribs located within the tube being welded to and extending between the first flanged-coupling pulley and the tube, the ribs extending essentially in a radial direction.

6. A drum of a winch as claimed in claim 4, wherein six ribs are provided in equally spaced relationship with an angle of 60° (sixty detrees) between adjacent ribs.

7. A drum of a winch as claimed in claim 1, wherein, on a circle around the center point of said connecting disc, each one of said threaded holes is arranged in adjacent relationship to a hole for a dowel pin.

8. A drum of a winch as claimed in claim 5, wherein six ribs are provided in equally spaced relationship with an angle of 60° (sixty degrees) between adjacent rib.

9. A drum (10) of a winch assembled from parts which are preferably joined by means of weldings (54, 56, 58, 60, 62, 64, 66, 68, 70), said drum (10) comprising a first flanged-coupling pulley (14) having a pivot (20) disposed therein and welded thereto, a tube (12) disposed between and welded to to said first flanged-coupling pulley (14) and a second flanged-coupling pulley (16), and a connecting disc (18) for connecting the drum to a suitable means for driving the drum welded to said tube (12) adjacent to said second flanged-coupling pulley (16), wherein two semimonocoque guiding parts (36,38;40,42) are provided at the outer peripheral surface of said tube (12), said semimonocoque guiding parts comprising winding grooves for a cable for guiding said cable, wherein the ratio of the diameter (D) of said tube (12) to the diameter (d) of said cable is larger than 20, wherein a cable receiving means (26) for receiving and holding the end of the cable is mounted on the first flanged-coupling pulley (14) and the tube (12) where the first flanged-coupling pulley (14) and the tube (12) meet, said cable receiving means (26) having at least one clamping means (30,32) for clamping said cable to the drum, wherein said clamping means includes a clamping jaw (30), and a pressing screw (32) arranged in radial relationship to the longitudinal axis of said cable receiving means (26), said pressing screw (32) acting on the clamping jaw (30), wherein said connecting disc (18) has six ribs (48, 50, 96, 98, 100, 102) welded thereto for providing a support against the inner circumferential surface of said tube (12), said ribs being in an equally spaced relationship with an angle of 60° (sixty degrees) between adjacent ribs, wherein said first (14) and said second flanged-coupling pulleys are provided with ribs disposed at the side of said pulleys facing said tube (12), said ribs extending essentially in a radial direction, said ribs being in an equally spaced relationship with an angle of 60° (sixty degrees) between adjacent ribs, wherein said connecting disc (18) is provided with symmetrically arranged threaded holes (72, 74, 76, 78, 80, 82) for receiving screws which connect the drum to the driving means and which receive the axial loads on the drum and with symmetrically arranged holes (84, 86, 88, 90, 92, 94) adapted for receiving dowel pins which connect the drum to the driving means and which receive the radial loads on the drum, and wherein on a circle around the center point of said connecting disc (18), each one of said threaded holes is arranged in adjacent relationship to a hole for a dowel pin.

10. A drum of a winch comprising (a) a tube means (12), (b) at the ends of which a first and a second flanged-coupling pulley means (14, 16) are disposed, (c) a pivot means (20) disposed in said first flanged-couling pulley means (14), (d) connecting disc means (18) arranged inside said tube means (12), adjacent to said second flanged-coupling pulley means (16), wherein (e) said connecting disc means (18) has rib means (48, 50, 96, 98, 100, 102) for providing a support against the inner circumferential surface of said tube means (12), (f) rib means disposed between said first or second flanged-coupling pulley means (14, 16) and said tube means (12), said rib means extending essentially in a radial direction, (g) tube means (12), pulley menas (14,16), disc means (18), pivot means (20) and rib means (48, 50, 96, 98, 100, 102) being joined by means of weldings (54, 56, 58, 60, 62, 64, 68, 70), and (h) threaded holes (72, 74, 76, 78, 80, 82) for receiving screws and holes (84, 86, 88, 90, 92, 94) for receiving dowel pins, being symmetrically arranged in said connecting disc means (18).

11. The drum of claim 10, wherein two semimonocoque guiding parts (36, 38; 40, 42) are provided at the outer peripheral surface of said tube means (12), said semimonocoque guiding parts comprising winding grooves for a cable for guiding said cable.

12. The drum of claim 10, wherein six ribs are provided in equally spaced relationship with an angle of 60° (sixty degrees) between adjacent rib means.

13. The drum of claim 10, wherein on a circle around the center point of said connecting disc means, each one of said threaded holes is arranged in adjacent relationship to a hole for a dowel pin.

14. The drum of claim 10, wherein the ratio of the diameter (D) of said tube means (12) to the diameter (d) of said cable is larger than 20.

15. The drum of claim 1, further including a plurality of ribs located within the tube being welded to and extending between the second flanged-coupling pulley and the tube, said ribs extending essentially in a radial direction.

* * * * *